US008984812B2

(12) United States Patent
Karallus et al.

(10) Patent No.: US 8,984,812 B2
(45) Date of Patent: Mar. 24, 2015

(54) APPARATUS FOR SHOCK-SECURE DOOR OR HATCH ARRANGEMENT ON MARINE SHIPS

(71) Applicant: ThyssenKrupp Marine Systems GmbH, Hamburg (DE)

(72) Inventors: Rainer Karallus, Horst (DE); Joerg Draeger, Seth (DE); Wolfram Determann, Norderstedt (DE); Gerardo Salazar, Hamburg (DE)

(73) Assignee: ThyssenKrupp Marine Systems GmbH, Hamburg (DE)

( * ) Notice: Subject to any disclaimer, the term of this patent is extended or adjusted under 35 U.S.C. 154(b) by 0 days.

(21) Appl. No.: 14/055,005

(22) Filed: Oct. 16, 2013

(65) Prior Publication Data

US 2014/0109480 A1 Apr. 24, 2014

(30) Foreign Application Priority Data

Oct. 23, 2012 (DE) ..... 10 2012 021 583

(51) Int. Cl.

| | |
|---|---|
| ***E05C 3/14*** | (2006.01) |
| ***E06B 3/34*** | (2006.01) |
| ***E06B 5/12*** | (2006.01) |
| ***B63B 19/00*** | (2006.01) |
| ***B63B 43/32*** | (2006.01) |
| ***E05B 17/20*** | (2006.01) |
| ***E05B 51/02*** | (2006.01) |

(Continued)

(52) U.S. Cl.

CPC ... *E05C 3/14* (2013.01); *E06B 3/34* (2013.01); *E06B 5/12* (2013.01); *B63B 19/00* (2013.01); *B63B 43/32* (2013.01); *E05B 17/2038* (2013.01); *E05B 51/02* (2013.01); *E05B 63/0052* (2013.01); *E05C 19/001* (2013.01)

USPC ..... 49/319; 49/316; 49/320; 49/321; 114/117; 114/116

(58) Field of Classification Search

CPC ..... E06B 7/18; E05C 19/003; E05B 65/001; E05F 11/10

USPC ..... 49/316, 319, 320, 321; 114/116, 117, 114/203, 201 R

See application file for complete search history.

(56) References Cited

U.S. PATENT DOCUMENTS

| | | | | | |
|---|---|---|---|---|---|
| 121,701 | A | * | 12/1871 | Brown | 49/320 |
| 2,271,952 | A | * | 2/1942 | Raus | 114/117 |

(Continued)

FOREIGN PATENT DOCUMENTS

| | | | |
|---|---|---|---|
| DE | 102006041192 | | 3/2008 |
| GB | 774536 | * | 4/1954 |

*Primary Examiner* — Katherine Mitchell
*Assistant Examiner* — Marcus Menezes
(74) *Attorney, Agent, or Firm* — W. F. Fasse

(57) ABSTRACT

In a shock-secure door or hatch arrangement on marine ships, a doorway frame, on two opposite longitudinal edges thereof, has continuous latching bars that are receivable in corresponding grooves in opposite edges of a door in order to latch the door in a closed position. The latching bar on the hinged edge of the doorway frame is stationary and engages into the associated door edge groove during a closing motion of the door. The latching bar on the opposite edge of the doorway frame is movable by actuating elements so as to engage into the respective associated door edge groove for latching the door in its closed position. A locking mechanism locks and unlocks the movable latching bar in its latched position.

19 Claims, 8 Drawing Sheets

(51) Int. Cl.
*E05B 63/00* (2006.01)
*E05C 19/00* (2006.01)

(56) References Cited

U.S. PATENT DOCUMENTS 2,739,343 A * 3/1956 Rahm ..... 16/287
2,766,860 A * 10/1956 Travis ..... 49/318
3,647,169 A * 3/1972 Allwright et al. ..... 244/129.5
3,889,421 A * 6/1975 Ahonen ..... 49/395
5,086,587 A * 2/1992 Andrews ..... 49/395
5,736,671 A * 4/1998 Perala et al. ..... 174/365
6,675,536 B1 * 1/2004 Williams et al. ..... 49/395
6,799,396 B1 * 10/2004 Redfern et al. ..... 49/395
7,213,530 B2 * 5/2007 Dasilva et al. ..... 114/117
8,091,282 B2 * 1/2012 Speyer et al. ..... 49/317
2008/0295410 A1 * 12/2008 Salerno ..... 49/394
2011/0107674 A1 * 5/2011 Sauter ..... 49/316

* cited by examiner

APPARATUS FOR SHOCK-SECURE DOOR OR HATCH ARRANGEMENT ON MARINE SHIPS

PRIORITY CLAIM

This application is based on and claims the priority under 35 USC 119 of German Patent Application 10 2012 021 583.5, filed on Oct. 23, 2012, the entire disclosure of which is incorporated herein by reference.

FIELD OF THE INVENTION

The invention relates to an apparatus for shock-secure arrangement of a door or hatch on marine ships, whereby a door leaf is movably arranged via hinges on a doorway frame so that the door can move between open and closed positions relative to the doorway opening. Latching elements are operable via a handle for latching the door leaf in its closed position in the doorway frame.

BACKGROUND INFORMATION

Various door and hatch arrangements of the above general type are known for use on marine ships. With such known arrangements, difficulties exist with regard to transmitting the forces of shock events into the doorway frame in order to prevent an unintended springing-open of the door in case of a shock.

For securing a ship door against shock as mentioned above, it is already known from the German patent publication DE 10 2006 041 192 B3, to carry out a latching or locking between the door leaf and the doorway frame by slidable rod linkage elements via a plurality of corresponding latching tongues or strap plates distributed around the perimeter of the door, and to form a closed perimeter-encircling operating ring via ball elements in corner areas. In this regard, difficulties exist in the operation thereof by additional remote-controllable handling elements, and the danger exists that the rod linkages will no longer be operable in a correct orderly manner after shock loading.

SUMMARY OF THE INVENTION

In view of the above, it is an object of the invention to provide an embodiment for a force-withstanding stability door that is strongly loadable by shock loading, which prevents an unintended springing-open thereof and also permits a remotely-controllable opening and closing thereof. The invention further aims to avoid or overcome the difficulties or disadvantages of the prior art, and to achieve additional advantages, as apparent from the present specification. The attainment of these objects is, however, not a required limitation of the claimed embodiments of the invention.

The above objects have been achieved according to the invention in a door arrangement for a ship, comprising a doorway frame bounding a doorway opening, a door movably mounted by a hinge arrangement to the doorway frame, and a latching mechanism. Opposite first and second frame edges of the doorway frame respectively have first and second latching bars that extend longitudinally along the frame edges and along the doorway opening. The first latching bar is a movable latching bar. The door is movable between an open position and a closed position in which the door respectively opens and closes the doorway opening. Opposite first and second door edges of the door respectively have therein first and second latching grooves that extend longitudinally along the door edges and that are configured to receive at least partly therein the first and second latching bars when the door is in the closed position. The latching mechanism is connected to the movable first latching bar and adapted to move the movable first latching bar into and out of the first latching groove when the door is in the closed position so as to respectively latch and unlatch the door in the closed position.

The term "door" includes any door, hatch, portal cover, and any other movable cover of a passage or access opening on a ship. The term "ship" includes any ship, boat, and any other watercraft. The terms "hinge" and "hinge arrangement" include any mechanism and any components for movably supporting a door relative to a doorway frame or structure around a passage or access opening, whereby the door may pivot, swing, slide and/or shift to move between an open position and a closed position. The hinge arrangement may include plural individual hinges or a single hinge in the nature of a full-length piano hinge. The term "bar" as in the "latching bar" refers to any elongated member or element in the configuration of a bar, a rail, a batten, a strip, a rod, or the like. Various components may be made of metal, fiber reinforced synthetic composite material and/or other suitable materials known in the art. The location of the latching grooves and the latching bars may be reversed, i.e. the grooves may be on the doorway frame and the bars may be on the door edges, whereby the latching mechanism would be provided on the door itself.

In particular embodiments of the invention, the ship's door arrangement can have the following particular features. The doorway frame comprises continuous or through-going latching bars or rails as latching elements on two mutually oppositely located longitudinal sides, which latching bars or rails are receivable in corresponding grooves of a door leaf frame, whereby the side of the door leaf pivotably connected with the doorway frame comprises a stationary latching bar for engaging into the groove of the door leaf frame during a closing motion of the door leaf, and a latching bar that is adjustable in the doorway frame is guided on the oppositely located side, which adjustable latching bar is insertable into a groove of the door leaf frame via adjustment elements in the closed position of the door leaf.

By this arrangement, an allocation of the individual elements with relatively small play is possible, and a continuous or through-going uptake of arising shock loads is ensured without impairments.

A simple actuation or control exists in that the adjustment elements for the latching bar are formed by pneumatic cylinders and/or manually-actuatable, pivotable operating levers.

Furthermore, for security and avoiding an unintended sliding displacement of the latching bar from its latched position when the door is in the closed position, it is suggested to further provide a securing or locking rod arranged parallel to the latching bar in the doorway frame. The locking rod is arranged to be movable vertically or perpendicularly to the motion of latching bar via an allocated operating lever. In this regard a portion of the locking rod is embodied as a toothed gear rack, into which a corresponding tooth or gear element of the pivot axis of the operating lever engages for moving the locking rod. A locking coupling couples the locking rod with the latching bar so that in one of its positions the locking rod allows free motion of the latching bar, but in another one of its positions the locking rod blocks and prevents an unlatching motion of the latching bar.

To achieve or enable a small play and thus a relatively tight fit between the door leaf and the doorway frame, it is provided that the sectional profiles of the edges of the door leaf frame facing the doorway frame comprise a sloping taper in the area adjoining the latching grooves and facing the latching bars for guiding or slidingly urging the latching bars into the latching grooves.

Further it is advantageous that the pivotable operating levers act on the latching bar via bolts or pins via an over-dead-center bearing or over-center toggle in the latching position.

As an additional security or safety, it is provided that the outwardly located surfaces of the door leaf and doorway frame have, mounted thereon, respective corresponding or mating fixture elements that brace against one another in the closed position of the door, so as to act as shock limiters or shock-transmitting elements.

BRIEF DESCRIPTION OF THE DRAWINGS

In order that the invention may be clearly understood, it will now be described in connection with example embodiments thereof, with reference to the accompanying drawings, wherein.

DETAILED DESCRIPTION OF PREFERRED EXAMPLE EMBODIMENTS AND OF THE BEST MODE OF THE INVENTION

Figure 1:
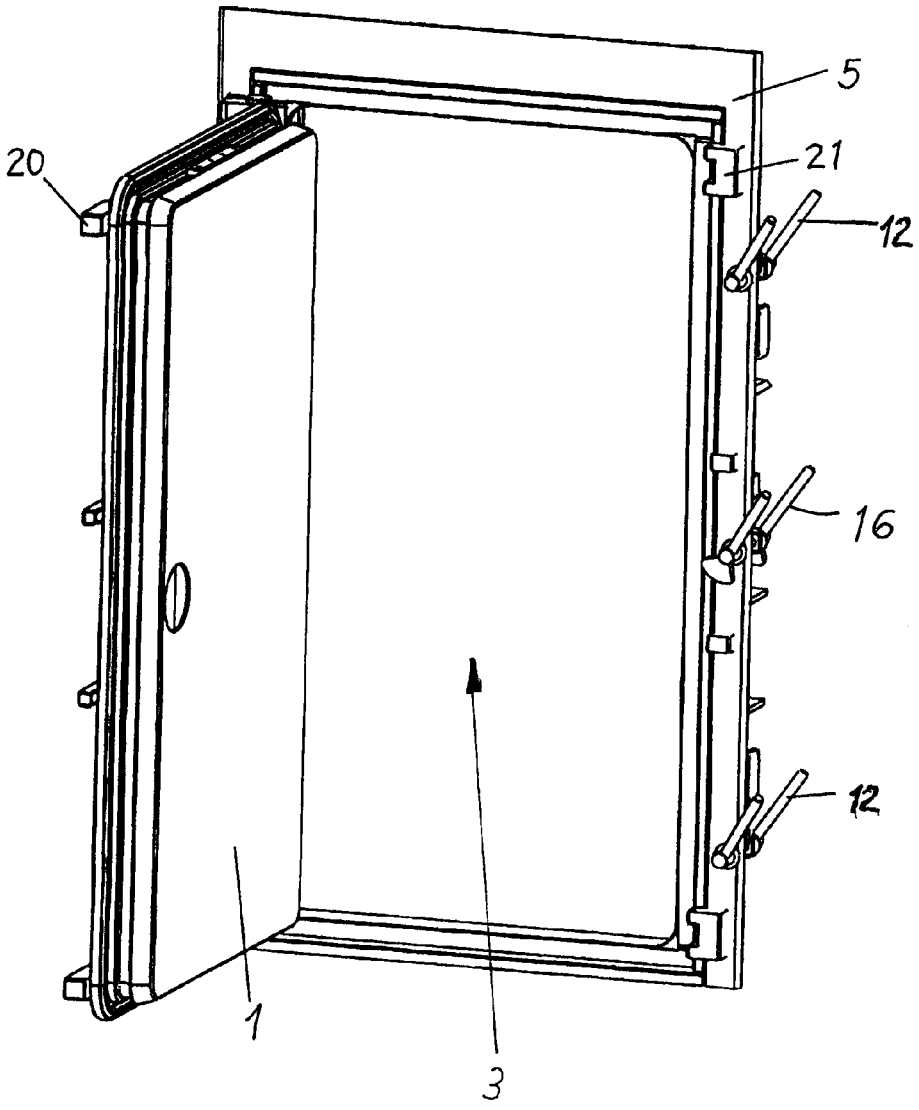
FIG. 1 is a schematic overall perspective illustration of an embodiment of a door arrangement according to the invention in an opened position.
Figure 2:
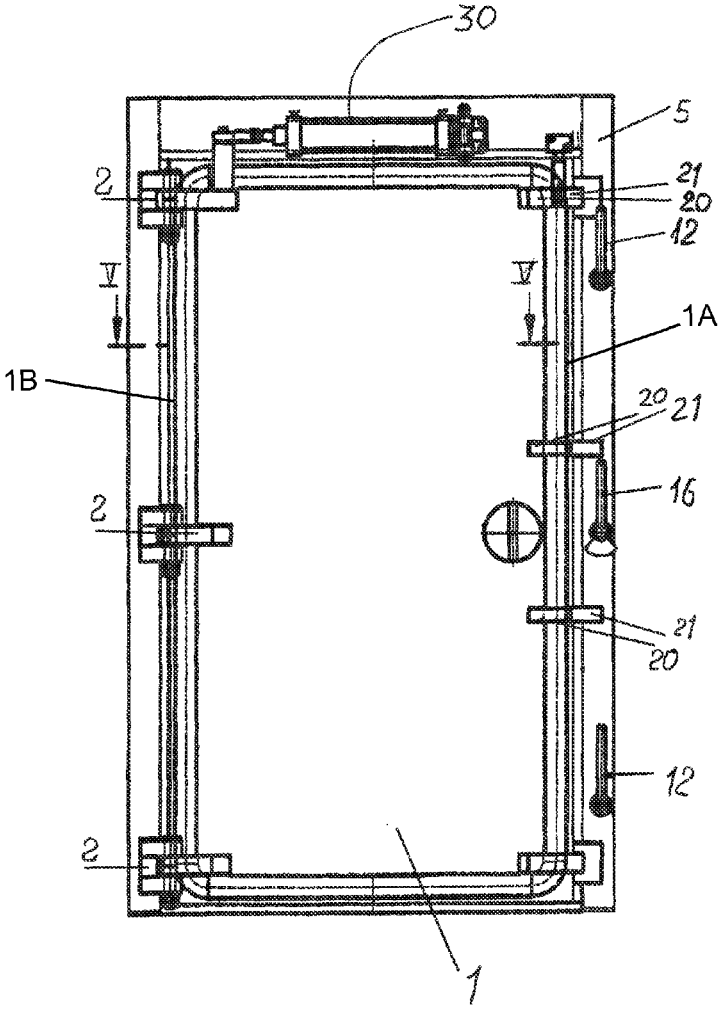
FIG. 2 is a front elevation view of the door arrangement according to FIG. 1 in a closed position, with an additional actuating cylinder for opening and closing the door.
Figure 3:
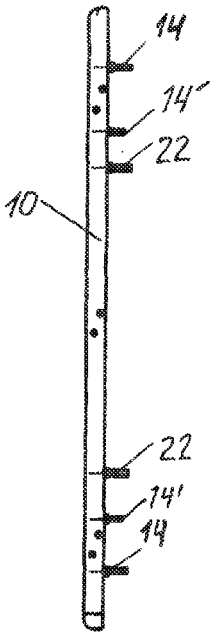
FIG. 3 is a front partial detail view of an adjustable or movable latching bar or rail used in an embodiment of the inventive door arrangement.
Figure 4:
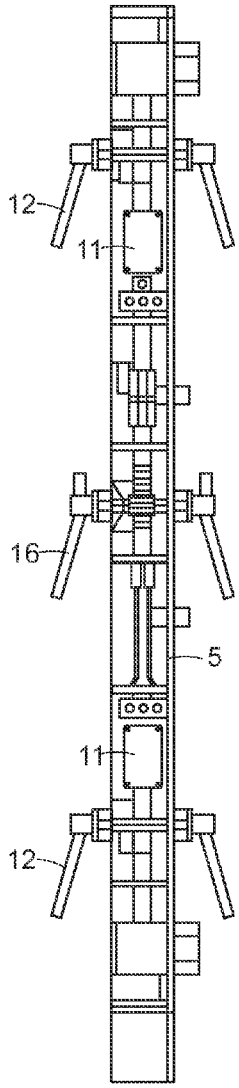
FIG. 4 is a sectional side view of the doorway frame with the adjustment or actuating elements for moving the movable latching bar.

In the illustrated arrangement, a door leaf 1 as a door element is connected pivotably via hinges 2 for closing an opening 3 on a doorway frame 5 fixedly or stationarily provided on a bulkhead 4 or partition of a ship. As shown in FIG. 2, a pneumatic (or hydraulic) actuating cylinder 30 is connected to the door leaf 1 and to the doorway frame 5, and is adapted to actuate an opening or closing motion of the door leaf 1 automatically or by remote control via an electro-pneumatic (or electro-hydraulic) control arrangement. The door leaf 1 may also be opened and closed manually by operating the lock operating lever 16 and the latch operating lever(s) 12.

Figure 5:
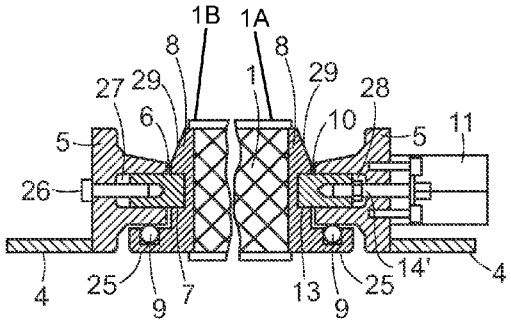
FIG. 5 is a broken partial top view sectional illustration of the door edges and the doorway frame according to the section line V-V of FIG. 2 with the latching bars in a latching position.
Figure 6:
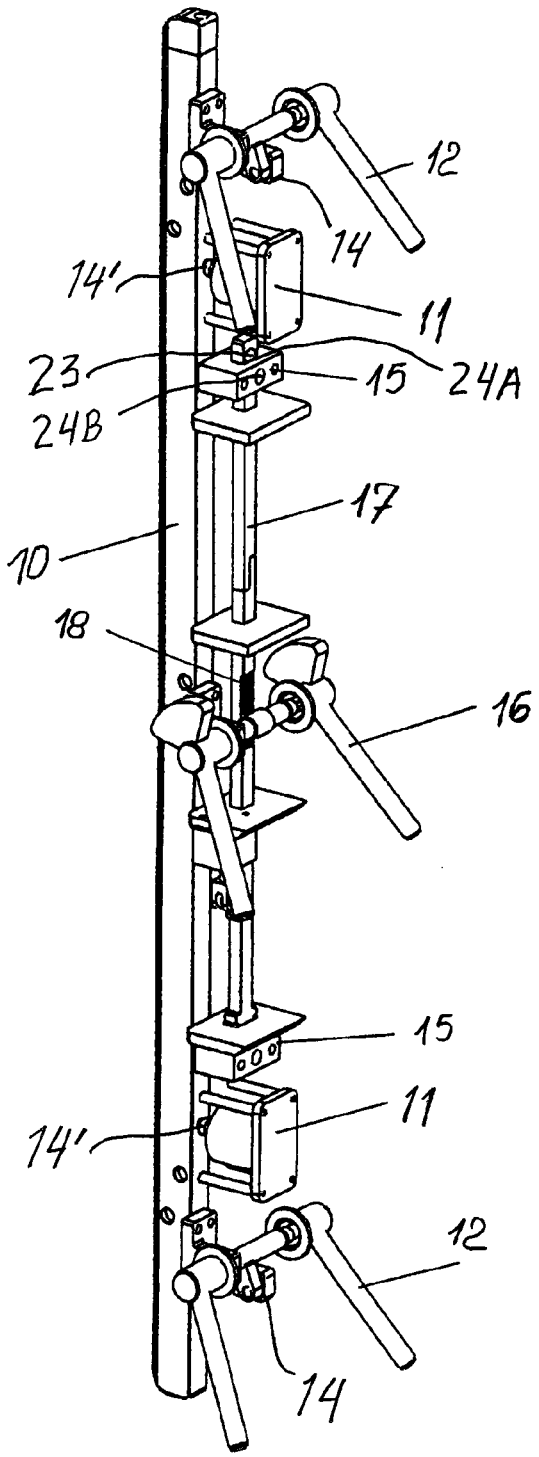
FIG. 6 is a perspective illustration of an adjustable or movable latching bar with its actuating elements and the locking rod mechanism.
Figure 7:
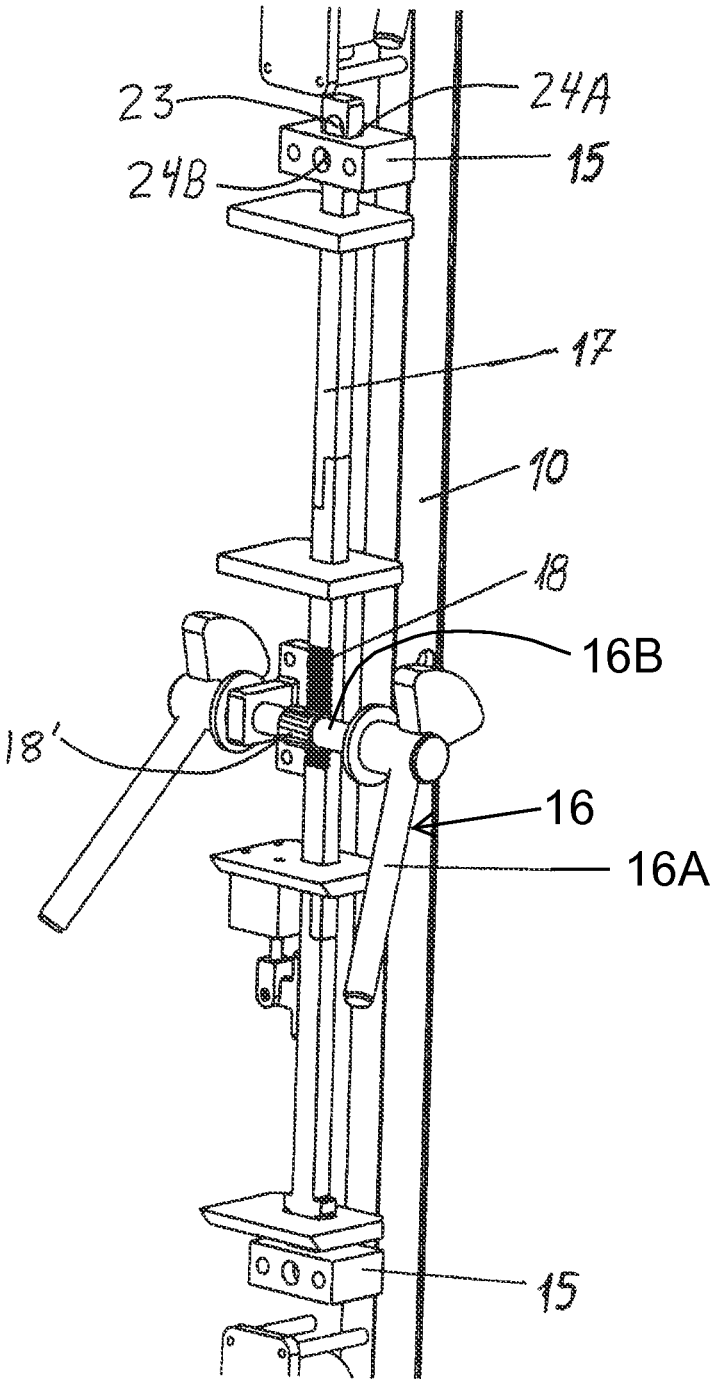
FIG. 7 is an enlarged perspective illustration of a partial area according to FIG. 6, but seen from the back instead of the front.

The doorway frame 5 on the hinge side, i.e. adjacent to a second edge 1B of the door leaf 1 at which the door leaf 1 is mounted on the hinges 2, has a stationary latching bar or rail 6 for engagement or insertion in a corresponding groove 7 of a door leaf frame 8 forming the corresponding second edge 1B of the door leaf 1. The sectional profile at the second edge 1B of the door leaf frame 8 in this embodiment has a sloping taper 29 for guiding the latching bar 6 into the groove 7, as shown in FIG. 5. The opposite first edge 1A of the door leaf 1 may also have a similar sloping taper 29 as also shown in FIG. 5. A protruding external rim 25 of the door leaf frame 8 overlaps onto the doorway frame 5 and is provided with a seal 9 that lies in contact on the doorway frame 5 in the closed condition of the door leaf 1 in order to seal the doorway opening. In that regard, the stationary latching bar 6 is arranged adjustably in a receiving groove 27 in the doorway frame 5, and may be adjustably and removably secured or fixed in a stationary adjusted position in the receiving groove 27 by a bolt 26.

Figure 8:
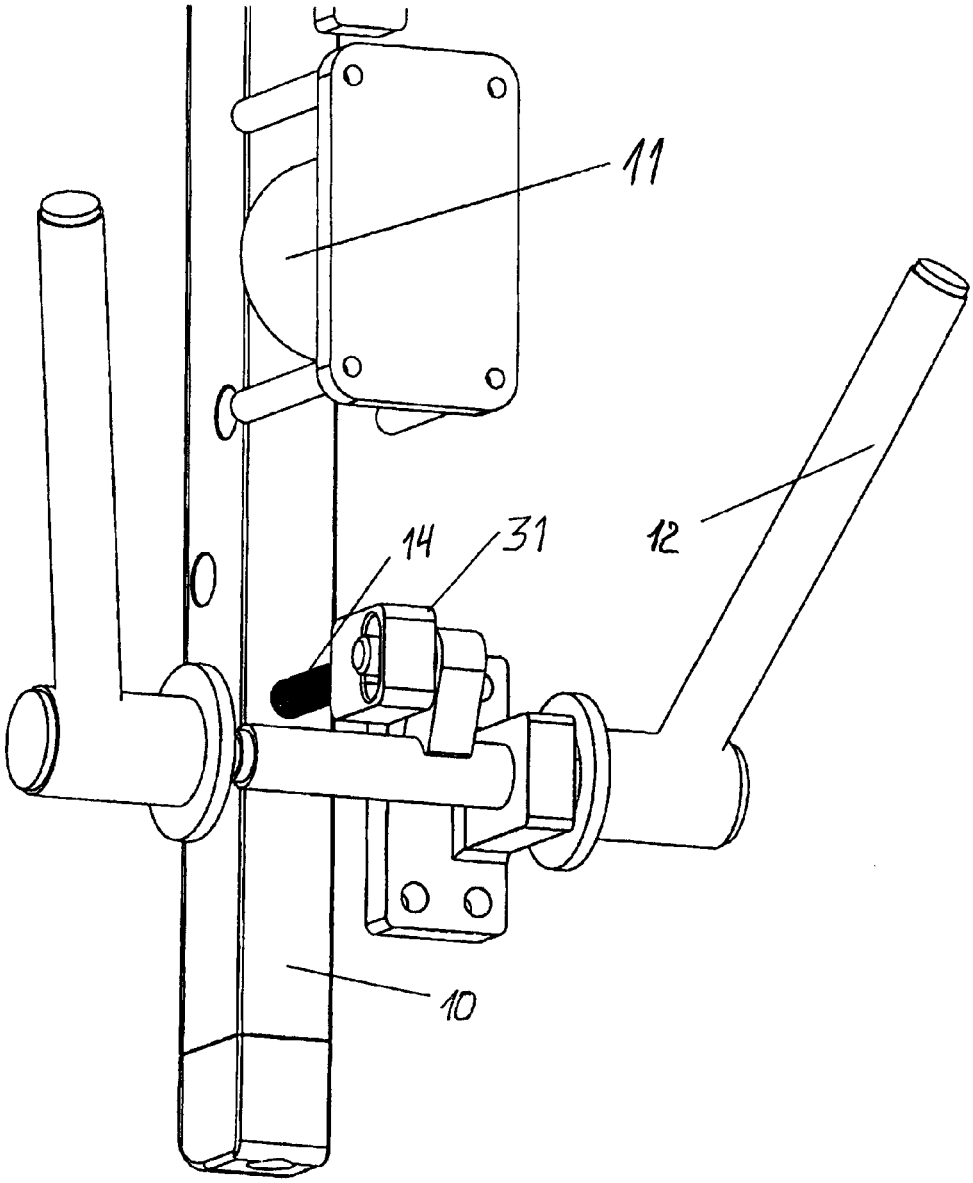
FIG. 8 is an enlarged perspective illustration of another portion of FIG. 6, showing an adjustable operating lever for actuating or moving the movable latching bar.
Figure 9:
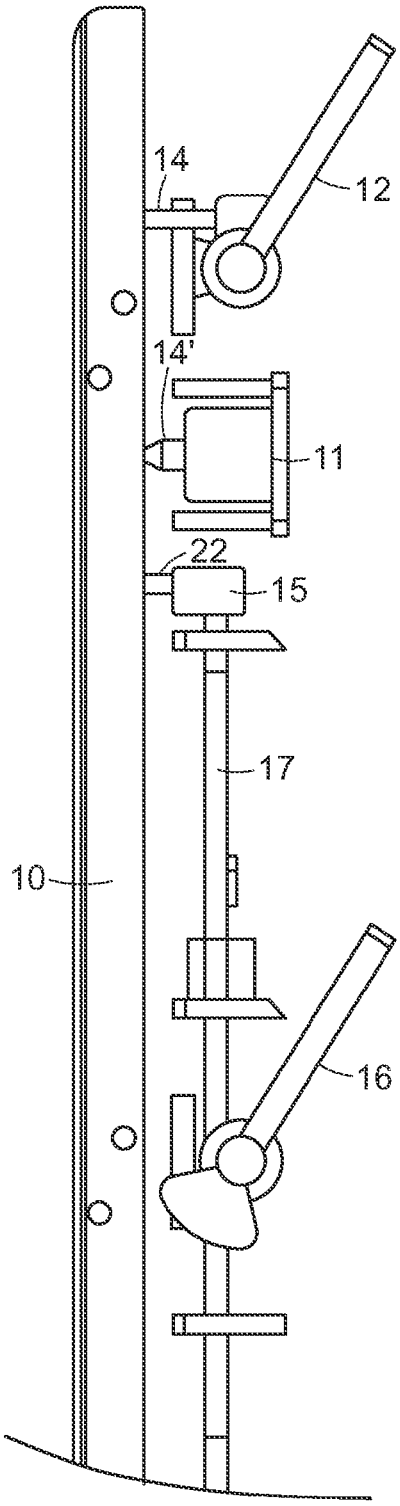
FIG. 9 is a schematic diagram of a portion of the arrangement of FIG. 6, to further explain the operation of the locking rod and locking mechanism.

In comparison, the doorway frame 5 on the oppositely located side has a movable latching bar 10 that is guided and adjustable in the doorway frame 5, particularly in a receiving groove 28 in the doorway frame 5, and that is insertable into a corresponding groove 13 of the door leaf frame 8 on the first edge 1A of the door leaf 1 for latching the door. The movable latching bar 10 is actuated between its latched extended position and its unlatched retracted position, and is held in this latched position or unlatched position, via pneumatic (or hydraulic) cylinders 11 and/or pivotably arranged manual operating levers 12. In that regard, the pneumatic cylinders 11 and the operating levers 12 engage the latching bar 10 via bolts 14' and 14 respectively. The pivoted operating levers 12 are held in the latched position and in the unlatched position via an over-center toggle or over-dead-center-point mechanism 31 (see especially FIG. 8).

As shown in FIGS. 6, 7, 9, 10A, 10B and 10C, a securing or locking rod 17 is arranged parallel to the movable latching bar 10 in the doorway frame 5. After latching the door leaf 1 in its closed position by moving the movable latching bar 10 to engage into the door edge groove 13, then the locking rod 17 can be moved to prevent a sliding displacement of the latching bar 10 out of its extended latched position. This is achieved as follows. Generally, a locking coupling comprises a guide block 15 and a locking pin 22 that extends from the movable latching bar 10 and is guided in the guide block, and the locking rod 17 is guided in the guide block transversely to the locking pin 22 so that the locking rod blocks and unblocks travel of the locking pin dependent on the position of the locking rod.

Figure 10A:
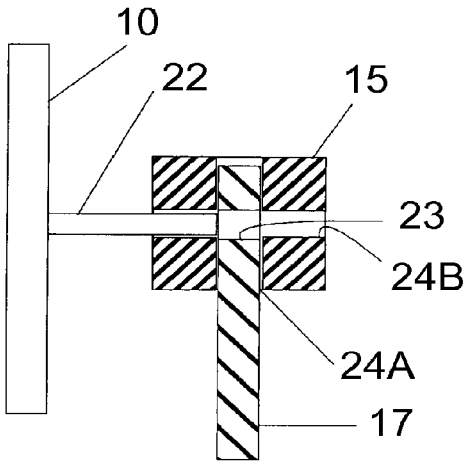
FIGS. 10A, 10B and 10C are schematic diagrams illustrating an enlarged portion of FIG. 9 in section, respectively in three different operating states.
Figure 10B:
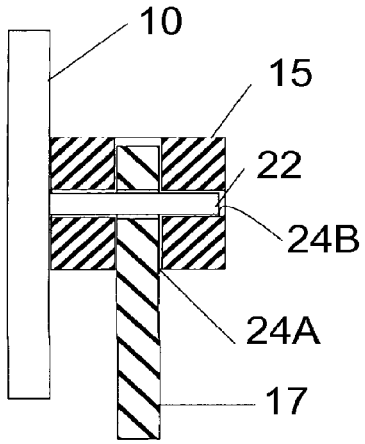
Figure 10C:
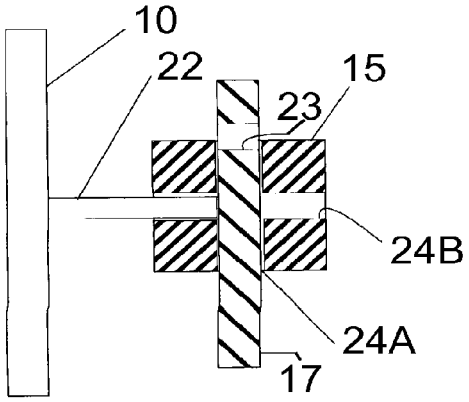

More particularly, in the illustrated embodiment, manually pivoting a lever handle 16A of an operating lever 16 causes a vertical sliding motion of the locking rod 17, because an engagement portion of the locking rod 17 is embodied as a toothed gear rack 18, which is engaged by a corresponding tooth or gear element 18' provided on the pivot shaft or lever shaft 16B of the operating lever 16. The opposite distal free ends of the locking rod 17 respectively extend through and are slidably guided in vertical first guide channels or holes 24A in guide blocks 15. Locking pins 22 extend horizontally from the movable latching bar 10 and respectively extend into and are slidably guided in horizontal second guide channels or holes 24B that intersect the first guide channels 24A in the guide blocks 15. Further in the illustrated embodiment, the locking rod 17 has holes 23 which are brought into alignment with the second guide channels 24B by appropriately sliding the locking rod 17 into an unlocked but latched position as shown in FIG. 10A. Thus, in the unlocked but latched position of FIG. 10A, the locking pins 22 of the movable latching bar 10 can slide laterally outwardly away from the door through the second guide channels 24B in the guide block 15 and the holes 23 of the locking rod 17 received in the first guide channels 24A of the guide block 15. Thereby, the movable latching bar 10 is free to move from its latched position (FIG. 10A) to its unlatched position (FIG. 10B) as the locking pins 22 slide outwardly through the channels 24B and holes 23 as described above. On the other hand, when the movable latching bar 10 is in its latched position (FIGS. 10A and 10C), the locking pins 22 are retracted out of the holes 23 of the locking rod 17. Thus, the locking rod 17 can be moved to its locked position (FIG. 10C), in which the holes 23 do not align with the second guide channels 24B of the guide block. Thereby, in the locked position (FIG. 10C) the locking rod 17 blocks the second guide channels 24B so that the locking pins 22 cannot slide outwardly, and therefore the movable latching bar 10 cannot move outwardly out of its latched position (FIGS. 10A and 10C) to its unlatched position (FIG. 10B). Alternatively, the locking rod need not have holes 23 therein, but rather the unlocked position of the locking rod would retract the locking rod tips sufficiently so that the locking pins can pass by the tips of the locking rod in the guide block.

Additionally, fixture elements 20 and 21 are applied on the outwardly located surfaces of door leaf 1 and doorway frame 5, and these fixture elements 20 and 21 butt or contact against one another in the closed position and serve as shock limiters or shock force transmitting elements.

In further detailed embodiments of the door arrangement, the latching bars respectively extend continuously along at least 75%, or even at least 90%, or even essentially full-length, of a total length of the vertical doorway frame edges. The latching bars preferably extend along the two opposite longer edges of a rectangular (non-square) door, but in alternative embodiments, the latching bars extend along the two opposite shorter edges of such a door. The latching bars are preferably provided along the hinge-side edge and the opposite edge of the door arrangement. The hinge arrangement being "proximate" to an edge of the door means that the hinge arrangement is mounted or connected closer to that edge than the opposite edge of the door.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims. The abstract of the disclosure does not define or limit the claimed invention, but rather merely abstracts certain features disclosed in the application.

The invention claimed is:

1. A door arrangement for a ship, comprising:

a doorway frame bounding a doorway opening, wherein opposite first and second frame edges of said doorway frame respectively have first and second bars that respectively extend longitudinally along said first and second frame edges and along said doorway opening, and wherein said first bar is a movable first bar;

a door movably mounted by a hinge arrangement to said doorway frame, such that said door is movable between an open position and a closed position in which said door respectively opens and closes said doorway opening, wherein opposite first and second door edges of said door respectively have therein first and second grooves that extend longitudinally along said door edges and that are configured to receive at least partly therein said first and second bars when said door is in said closed position;

a latching mechanism that is connected to said movable first bar and is adapted to move said movable first bar into a latched position in said first groove and into an unlatched position out of said first groove when said door is in said closed position so as to respectively latch and unlatch said door in said closed position;

a locking rod that is arranged parallel to said movable first bar and parallel to said first frame edge in or on said doorway frame;

a manually operable locking lever that is drive-connected to said locking rod so as to move said locking rod parallel to a longitudinal extension direction of said movable first bar; and a locking coupling that couples said locking rod with said movable first bar so as to lock and unlock said movable first bar in said latched position thereof dependent on a position of said locking rod;

wherein said locking lever is drive-connected to said locking rod by an arrangement in which a portion of said locking rod comprises a toothed gear rack, said locking lever is a pivotable lever and comprises a lever handle, a lever shaft extending from said lever handle, and a gear wheel connected to said lever shaft and engaged with said toothed gear rack;

wherein said locking coupling comprises: a guide block having a first guide channel and a second guide channel therein; and a locking pin connected to and extending from the movable first bar;

wherein:

said first guide channel and said second guide channel intersect one another in said guide block;

said locking rod is slidably received in said first guide channel so that said locking rod is slidable between a locked position and an unlocked position;

said locking pin is slidably received in said second guide channel so that said locking pin is slidable together with said movable first bar between said latched position and said unlatched position;

when said locking pin is in said latched position and said locking rod is in said locked position, said locking rod blocks said second guide channel and thereby blocks said locking pin against sliding from said latched position to said unlatched position; and when said locking rod is in said unlocked position, said locking rod unblocks said second guide channel and thereby allows said locking pin to slide from said latched position to said unlatched position.

2. The door arrangement according to claim 1, wherein said hinge arrangement is connected to said door proximate to said second door edge and is connected to said doorway frame proximate to said second frame edge, and wherein said second bar is a stationary second bar that is positioned stationarily relative to said second frame edge and is configured and arranged to engage into said second groove when said door moves to said closed position.

3. The door arrangement according to claim 2, wherein said second frame edge of said doorway frame has a frame edge groove extending longitudinally therealong, and wherein said stationary second bar is partly received and supported in said frame edge groove and is secured in said frame edge groove.

4. The door arrangement according to claim 3, wherein said stationary second bar is adjustably and removably secured by bolts in said frame edge groove.

5. The door arrangement according to claim 2, wherein said first frame edge of said doorway frame has a frame edge groove extending longitudinally therealong, wherein said movable first bar is partly received and movably supported in said frame edge groove, and wherein said movable first bar is slidable farther out of and farther into said frame edge groove so as to respectively correspondingly move said movable first bar into and out of said first groove of said first door edge.

6. The door arrangement according to claim 1, wherein said door edges of said door have respective sloping surfaces that slope laterally outwardly to said first and second grooves and that are effective to cooperate with said first and second bars to guide and catch said first and second bars into said first and second grooves.

7. The door arrangement according to claim 1, wherein said first and second bars are respectively continuous along said first and second frame edges of said doorway frame.

8. The door arrangement according to claim 1, wherein said latching mechanism comprises at least one pneumatic cylinder device connected to said movable first bar.

9. The door arrangement according to claim 8, wherein said latching mechanism further comprises at least one manually operable pivotable lever connected by a linkage to said movable first bar.

10. The door arrangement according to claim 1, wherein said latching mechanism comprises at least one manually operable pivotable lever connected by a linkage to said movable first bar.

11. The door arrangement according to claim 10, wherein said linkage is an over-center toggle linkage.

12. The door arrangement according to claim 1, further comprising first fixture elements mounted on said door and second fixture elements mounted on said doorway frame such that said first fixture elements engage with and brace against said second fixture elements when said door is in said closed position.

13. The door arrangement according to claim 1, wherein said locking rod has a hole therein, said hole is aligned with said second guide channel and allows said locking pin to extend through said hole when said locking rod is in said unlocked position, and said hole is not aligned with said second guide channel when said locking rod is in said locked position.

14. A door arrangement comprising:

a first component and a second component each selected from the group consisting of a doorway frame bounding a doorway opening, and a door movably mounted to said doorway frame so as to be movable selectively between an open position and a closed position relative to said doorway opening;

a groove formed in and extending longitudinally along a first edge of said first component;

a movable latching bar extending longitudinally along a second edge of said second component;

a first actuator mounted in or on said second component, connected to said latching bar, and configured and arranged to move said latching bar in a first direction perpendicular to said second edge between a latched position in which said latching bar engages into said groove and thereby latches said door in said closed position, and an unlatched position in which said latching bar is disengaged out of said groove and thereby allows said door to move out of said closed position;

a guide block having a first guide channel and a second guide channel intersecting one another therein;

a locking rod extending longitudinally parallel to said latching bar in or on said second component, and slidably received in said first guide channel;

a locking pin connected to and extending from said latching bar, and slidably received in said second guide channel; and a second actuator mounted on said second component, connected to said locking rod, and configured and arranged to move said locking rod in a second direction parallel to said second edge between a locked position and an unlocked position;

wherein:

said locking pin is slidable together with said latching bar between said latched position and said unlatched position;

when said latching bar is in said latched position and said locking rod is in said locked position, said locking rod blocks said second guide channel and thereby blocks said locking pin and therewith said latching bar against sliding from said latched position to said unlatched position; and when said locking rod is in said unlocked position, said locking rod unblocks said second guide channel and thereby allows said locking pin and therewith said latching bar to slide from said latched position to said unlatched position.

15. The door arrangement according to claim 14, wherein said locking rod has a hole therein, said hole is aligned with said second guide channel and allows said locking pin to extend through said hole when said locking rod is in said unlocked position, and said hole is not aligned with said second guide channel when said locking rod is in said locked position.

16. The door arrangement according to claim 14, wherein said first actuator comprises a pneumatic or hydraulic cylinder actuator.

17. The door arrangement according to claim 16, wherein said first actuator further comprises a manually operable pivotable lever connected by a linkage to said latching bar.

18. The door arrangement according to claim 14, wherein said second actuator comprises a toothed rack connected to said locking rod, a toothed gear wheel engaged with said toothed rack, and a manually operable pivotable lever connected to said toothed gear wheel.

19. The door arrangement according to claim 14, wherein said first component is said door, and said second component is said doorway frame.

* * * * *